US008907999B2

(12) United States Patent
Kasahara

(10) Patent No.: US 8,907,999 B2
(45) Date of Patent: Dec. 9, 2014

(54) ELECTROPHOTOGRAPHIC IMAGE FORMING APPARATUS

(75) Inventor: Shigeru Kasahara, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/355,010

(22) Filed: Jan. 20, 2012

(65) Prior Publication Data

US 2012/0189334 A1 Jul. 26, 2012

(30) Foreign Application Priority Data

Jan. 20, 2011 (JP) ..... 2011-009698

(51) Int. Cl.

| | |
|---|---|
| ***B41J 2/385*** | (2006.01) |
| ***B41J 2/435*** | (2006.01) |
| ***B41J 2/47*** | (2006.01) |
| ***G03G 15/043*** | (2006.01) |
| ***G03G 15/32*** | (2006.01) |

(52) U.S. Cl.

CPC ..... *G03G 15/043* (2013.01); *G03G 15/326* (2013.01)

USPC ..... 347/237; 347/133; 347/236; 347/246; 347/247

(58) Field of Classification Search

USPC ..... 347/133, 236, 237, 246, 247

See application file for complete search history.

(56) References Cited

U.S. PATENT DOCUMENTS

| | | | | |
|---|---|---|---|---|
| 6,130,700 | A * | 10/2000 | Murayama et al. | 347/240 |
| 2004/0041758 | A1* | 3/2004 | Kurusu | 345/82 |
| 2006/0133435 | A1* | 6/2006 | Ikeda | 372/38.02 |
| 2008/0225106 | A1* | 9/2008 | Omori et al. | 347/237 |
| 2010/0061206 | A1* | 3/2010 | Watanabe et al. | 369/47.53 |

FOREIGN PATENT DOCUMENTS

| | | | |
|---|---|---|---|
| JP | 2002-335038 | A | 11/2002 |
| JP | 2003-344798 | A | 12/2003 |
| JP | 4123791 | B2 | 5/2008 |
| JP | 2008-213246 | A | 9/2008 |

OTHER PUBLICATIONS

Japanese Office Action for corresponding JP 2011-009698, mail date Apr. 28, 2014.

* cited by examiner

*Primary Examiner* — Justin Seo
*Assistant Examiner* — Kendrick Liu
(74) *Attorney, Agent, or Firm* — Rossi, Kimms & McDowell LLP

(57) ABSTRACT

An electrophotographic image forming apparatus that are capable of reducing the variation of the rise time of the laser light source due to the temperature change of the laser light source with a simple configuration. A laser light source emits a laser beam according to a driving signal in order to expose an image bearing member. A voltage detection unit detects terminal voltage of the laser light source. A drive unit has a voltage source that can control output voltage and supplies current corresponding to the output voltage of the voltage source to the laser light source when making the laser light source emit the laser beam according to the driving signal. A control unit controls the voltage source so that the output voltage of the voltage source generates current overshot to a target current based on the detection result of the voltage detection unit.

5 Claims, 6 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus.

2. Description of the Related Art

In recent years, it is examined that an image forming apparatus provided with an exposure device in which a laser light source scans and exposes a photosensitive drum employs a vertical-cavity-surface-emitting semiconductor laser as the laser light source in order to raise productivity and resolution thereof. The vertical-cavity-surface-emitting semiconductor laser emits a laser beam from a wafer surface.

The vertical-cavity-surface-emitting semiconductor laser has an advantage that the number of beams can be easily increased because of a two-dimensional arrangement of emission points in comparison with the edge emitting type semiconductor laser that emits a laser beam from the wafer edge. The vertical-cavity-surface-emitting semiconductor laser has potential as a laser light source of an exposure device in view of this advantage.

On the other hand, the vertical-cavity-surface-emitting semiconductor laser has a characteristic that a rise time from a supply timing of driving current to a risen timing (a timing at which light amount reaches target light amount) of the laser light source is longer than that of the edge emitting type semiconductor laser under the constant current control.

The long rise time of the laser light source thins a latent image. When the thinned latent image is developed as-is, an image quality deteriorates.

Particularly, the electrophotographic image forming apparatus is required to shorten the rise time of a laser light source in order to raise productivity and resolution by increasing modulation frequency of the laser light source.

The vertical-cavity-surface-emitting semiconductor laser has a characteristic that a rise time varies with internal temperature or its ambient temperature. Here, a variation of the rise time of the vertical-cavity-surface-emitting semiconductor laser as the temperature change will be described with reference to FIG. 7. FIG. 7 is a graph showing rising waveforms of a video signal Vo, driving current Id', and optical output of an emission section, when driving the emission section of a vertical-cavity-surface-emitting semiconductor laser by the conventional constant current control.

As shown in FIG. 7, when the video signal Vo on an H (High) level is inputted, the driving current Id' starts to supply. When the driving current Id' starts to supply, the optical output of the emission section (the waveform of the laser light) immediately rises to a certain light amount, and then, the light output gradually rises until it reaches a target light amount according to a time constant of a current control circuit. The delay between the rising of the optical output and the rising of the driving current Id (the video signal Vo) is influenced by temperature (temperature of the emission section or its ambient temperature). The rise time becomes longer in lower temperature (a solid line), and the rise time becomes shorter in higher temperature (a dotted line). Such a variation of the rise time of the emission section causes deterioration of image quality.

Therefore, the following driving system has been proposed in order to shorten the rise time of a vertical-cavity-surface-emitting semiconductor laser and to reduce the variation of the rise time according to the temperature change (see Japanese Patent No. 4,123,791 (JP4123791B)). This driving system drives the vertical-cavity-surface-emitting semiconductor laser by a voltage drive circuit at the rising, and then, corrects the rise time by changing the circuit to a current drive circuit. Each of the voltage drive circuit and the current drive circuit is provided with a correction circuit that corrects the variation of the light amount according to the temperature change.

However, since the driving system disclosed in JP4123791B requires both of the voltage drive circuit and the current drive circuit that have the correction circuits, there is a problem that the large circuit scale increases a cost.

SUMMARY OF THE INVENTION

The present invention provides an electrophotographic image forming apparatus that are capable of reducing the variation of the rise time of the laser light source due to the temperature change of the laser light source with a simple configuration.

Accordingly, a first aspect of the present invention provides an electrophotographic image forming apparatus comprising a laser light source configured to emit a laser beam according to a driving signal in order to expose an image bearing member, a voltage detection unit configured to detect terminal voltage of the laser light source, a drive unit configured to have a voltage source that can control output voltage and to supply current corresponding to the output voltage of the voltage source to the laser light source when making the laser light source emit the laser beam according to the driving signal, and a control unit configured to control the voltage source so that the output voltage of the voltage source generates current overshot to a target current based on the detection result of the voltage detection unit.

According to the present invention, the variation of the rise time of the laser light source due to the temperature change of the laser light source can be reduced with a simple configuration.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
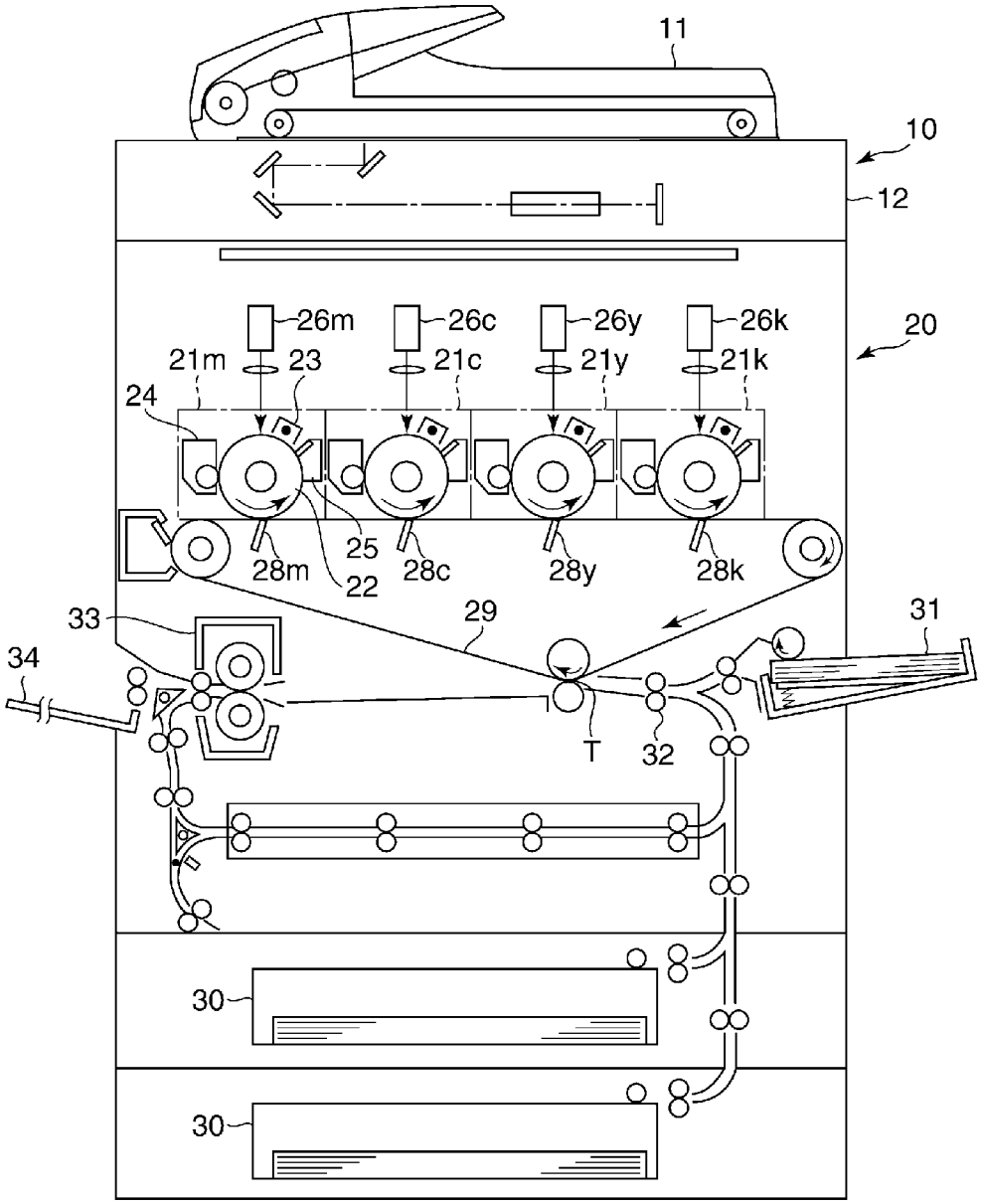
FIG. 1 is a longitudinal sectional view showing a configuration of an image forming apparatus according to an embodiment of the present invention.

FIG. 1 is a longitudinal sectional view showing a configuration of an image forming apparatus according to an embodiment of the present invention. The image forming apparatus of the embodiment provides a color copy function at least.

The image forming apparatus is provided with a reader 10 that can read a color image and a printer 20 that can form a color image as shown in FIG. 1. The reader 10 has an automatic original feeding device 11 that feeds an original one by one and a scanner 12 that can read an image on an original fed by the automatic original feeding device 11 in full color. The scanner 12 outputs the image data (image data of each color of R, G, and B) read from an original toward an image processing unit (not shown). The image processing unit applies a predetermined image process to the image data outputted from the scanner 12, converts the processed image data into the image data of each color of M (magenta), C (cyan), Y (yellow), and K (black), and outputs the image data of each color to the printer 20.

The printer 20 forms a color image or a monochrome image on a sheet with an electrophotography system based on the image data of each color (M, C, Y, K) outputted from the image processing unit. The printer 20 has a plurality of exposure units 26*m*, 26*c*, 26*y*, and 26*k* and a plurality of image forming units 21*m*, 21*c*, 21*y*, and 21*k* in detail.

The exposure units 26*m* through 26*k* modulate laser beams based on the corresponding image data of colors (M, C, Y, K), respectively, and the modulated laser beams concerned scan and expose photosensitive drums 22 of the corresponding image forming units 21*m* through 21*k*.

Each of the image forming units 21*m* through 21*k* has the photosensitive drum 22, an electrostatic charger 23, a development device 24, and a cleaner 25. Since the image forming units 21*m* through 21*k* have the same configuration, reference numerals are given only to the members of the image forming unit 21*m*, and reference numerals to the members of the other image forming units 21*c* through 21*k* are omitted.

A surface of the photosensitive drum 22 is electrified by the electrostatic charger 23 at predetermined electric potential, and then, is scanned and exposed by the laser beam from each of the exposure units 26*m*, 26*c*, 26*y*, and 26. Accordingly, the electrostatic latent image in the color corresponding to the image data is formed on the surface of the photosensitive drum 22. The electrostatic latent image formed on the photosensitive drum 22 is developed as a toner image by the development device 24, and is supported by the photosensitive drum 22. The cleaner 25 scrapes the residual toner from the surface of the photosensitive drum 22 after primary transfer, and collects it.

The toner images in the respective colors supported by the photosensitive drums 22 of the image forming units 21*m* through 21*k* are transferred to an intermediate transfer belt 29 with the corresponding primary transfer units 28*m* through 28*k* (primary transfer). Accordingly, a full color toner image is formed on the intermediate transfer belt 29.

The toner image transferred on the intermediate transfer belt 29 is transferred to a sheet that is fed to the secondary transfer position T from a sheet cassette 30 or a manual-bypass tray 31 through a registration roller 32 (secondary transfer). The sheet on which the toner image has been transferred is guided to a fixing unit 33, and the fixing unit 33 fixes the toner image to the sheet. The sheet to which the toner image has been fixed is ejected to a sheet ejection tray 34.

Figure 2:
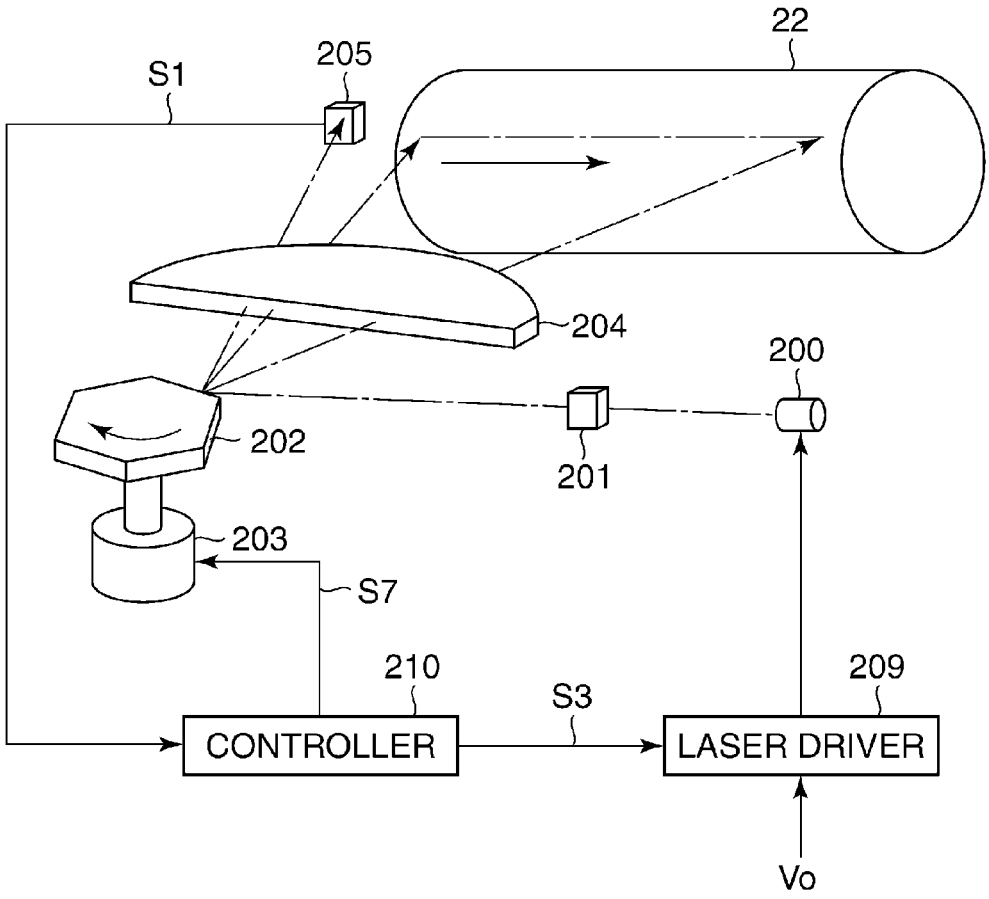
FIG. 2 is a schematic view showing a configuration of a main part of an exposure unit included in the image forming apparatus in FIG. 1.

Next, the exposure units 26*m* through 26*k* will be described in detail with reference to FIG. 2. FIG. 2 is a schematic view showing a configuration of a main part of each of the exposure units 26*m* through 26*k* in FIG. 1. Since the configurations of the exposure units 26*m* through 26*k* are identical, the configuration of the exposure unit 26*m* will be described.

The exposure unit 26*m* has a laser light source 200, a collimator lens 201, a polygon mirror 202, an f-theta lens 204, a beam detection sensor (referred to as a BD sensor) 205, and a laser driver 209, as shown in FIG. 2. The laser light source 200 consists of a vertical-cavity-surface-emitting semiconductor laser that has a plurality of emission sections arranged at predetermined intervals in an auxiliary scanning direction. This laser light source 200 is driven with higher modulation frequency (hundreds of MHz, for example) than the modulation frequency (tens of MHz) of the conventional edge emitting type semiconductor laser.

Laser beams that are emitted from the emission sections of the laser light source 200 are converted into parallel laser beams via the collimator lens 201, and then, enter into the polygon mirror 202 under rotation. The polygon mirror 202 is rotated by a scanner motor 203 in predetermined constant angular velocity.

The laser beams that entered into the polygon mirror 202 are reflected by the polygon mirror 202 and enter into the f-theta lens 204. The laser beams are converged by the f-theta lens 204, and form spots that scan the photosensitive drum 22 at uniform velocity in a principal scanning direction. The scans of the spots form linear latent images in the principal scanning direction on the surface of the photosensitive drum 22.

The BD sensor 205 outputs a beam detection signal (a BD signal) S1 to the controller 210, when the laser beam that is reflected by the polygon mirror 202 is detected in a compulsory lighting term during which the laser light source 200 is compulsorily turned on. This BD signal S1 is a reference signal of the image formation beginning timing for every principal scanning.

The controller 210 comprises a CPU, a ROM, RAM, an input/output interface (not shown), etc., controls the entire apparatus, and executes various processes including a process mentioned later.

The controller 210 executes a writing sequence based on the BD signal S1. The video signal Vo (driving signal) is inputted into the laser driver 209 when executing this writing sequence. The controller 210 generates a driving control signal S7 for driving the scanner motor 203, and outputs it to the scanner motor 203. The controller 210 outputs a sample hold signal S3 to a sample hold circuit 112 (FIG. 3) of the laser driver 209 as mentioned later.

The laser driver 209 is provided with drive circuits that generate and supply driving current for the respective emission sections of the laser light source 200.

Figure 3:
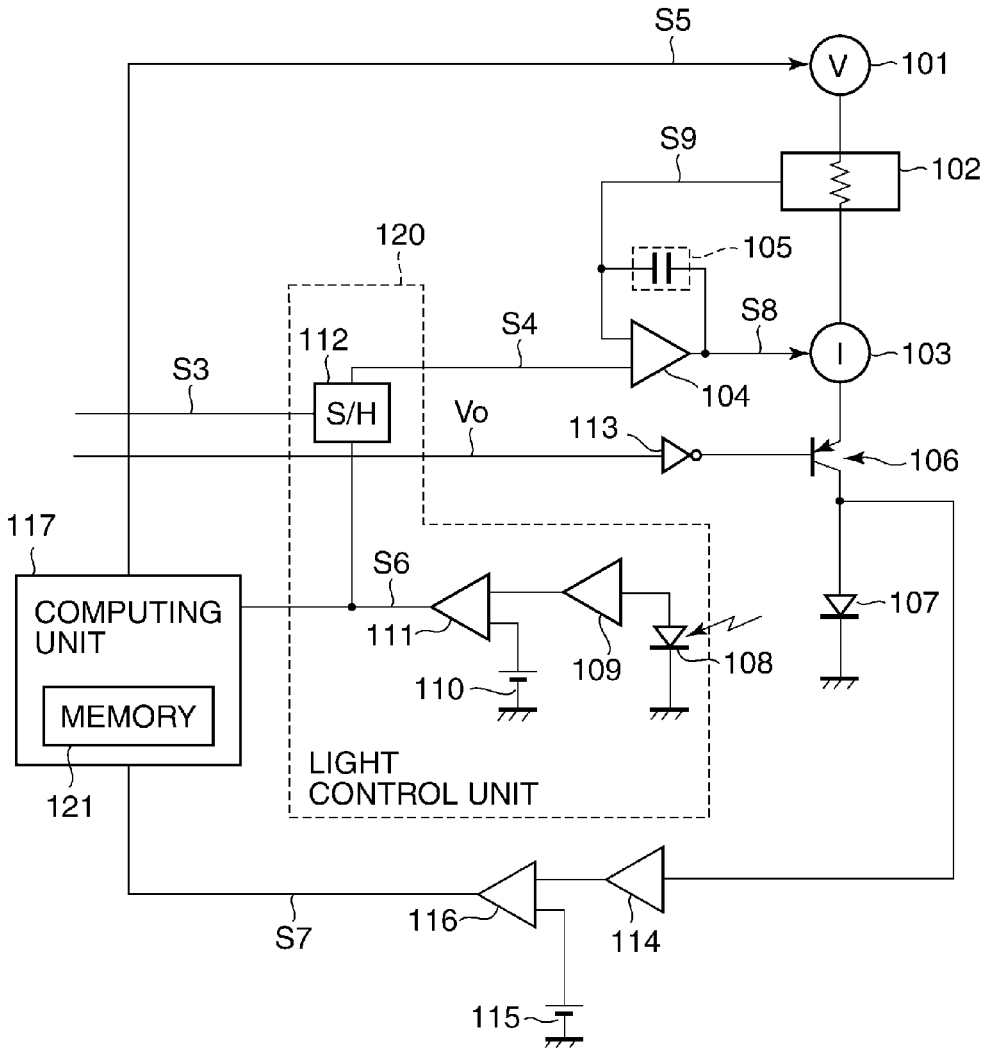
FIG. 3 is a circuit diagram showing a configuration of a drive circuit included in a laser driver of the exposure unit in FIG. 2.
Figure 4:
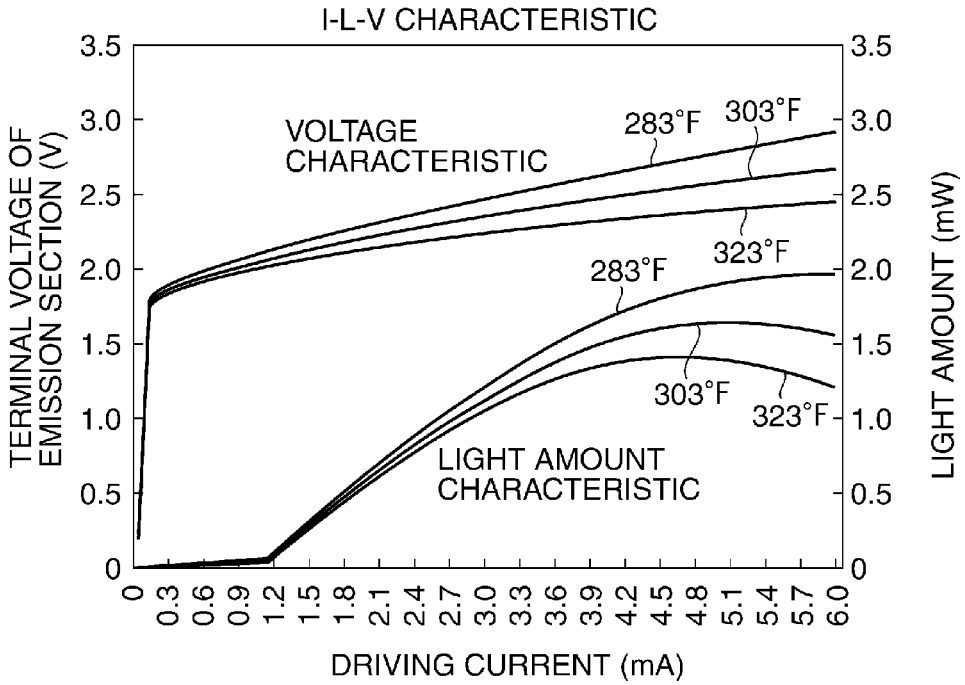
FIG. 4 is a graph showing an I-L-V characteristic that shows a relationship among terminal voltage corresponding to driving current, light amount, and ambient temperature of an emission section included in the drive circuit shown in FIG. 3.

Hereafter, a configuration of the laser driver 209 will be described with reference to FIG. 3 and FIG. 4. FIG. 3 is a circuit diagram showing the configuration of one drive circuit for driving one emission section among the drive circuits included in the laser driver 209 in FIG. 2. FIG. 4 is a graph showing an I-L-V characteristic that shows a relationship among terminal voltage corresponding to driving current Id for the emission section 107, light amount, and ambient temperature.

The drive circuit supplies the driving current Id for driving the emission section 107 corresponding to the video signal Vo to the emission section 107. The emission sections 107 of the laser light source 200 are arranged so as to form the corresponding principal scanning lines on the photosensitive drum, respectively.

The drive circuit has a voltage source 101, a current detecting circuit 102, a current control circuit 103, an error amplifier 104, a time constant circuit 105, a switching element 106, an inverter 113, a light control circuit 120, an amplifier 114, an error amplifier 116, and a computing unit 117.

The voltage source 101 is a variable voltage source that can control output voltage, and outputs the voltage V1 set by a voltage setting signal S5 as mentioned later. The current detecting circuit 102 detects the current supplied to the emission section 107 from the voltage source 101 via the switching element 106, and outputs a current detecting signal S9 that presents the detected current concerned.

The current control circuit 103 controls the current generated according to the voltage V1 outputted from the voltage source 101 based on a response control signal S8 from the error amplifier 104 mentioned later. In detail, the current control circuit 103 outputs the maximum current generated according to the voltage V1 outputted from the voltage source 101 as the driving current Id based on the above-mentioned response control signal S8. The maximum current is current overshot to target current. Then, the current control circuit 103 converges the above-mentioned driving current Id to the target current based on the above-mentioned response control signal S8 with a time constant determined by the time constant circuit 105.

The error amplifier 104 detects the difference between the current detecting signal S9 from the current detecting circuit 102 and the target current signal S4. Then, the signal that presents the difference is outputted to the current control circuit 103 as the response control signal S8. The difference varies so that the current corresponding to the current detecting signal S9 is gradually converged to the target current that presents the target current signal S4 within a time defined by the time constant determined by the time constant circuit 105.

The time constant circuit 105 comprises a capacitor and determines the time constant that is used when the current control circuit 103 converges the driving current Id to the target current as a time constant of operation of the drive circuit corresponding to the video signal Vo. The above-mentioned time constant is determined so that the rise time of the laser light source becomes short according to an output characteristic (a rising characteristic corresponding to an operating environment etc.) of the emission section 107 (the laser light source 200). Then, the capacity of the capacitor is selected so that the above-mentioned time constant is obtained.

An electric charge is accumulated to the capacitor while the switching element 106 is in an OFF state. Then, the electric charge accumulated in the capacitor is discharged in response to the lighting start of the emission section 107 (i.e., turn-ON of the switching element 106), and the discharge concerned is completed in time defined by the time constant.

The details of setting of the time constant determined by the time constant circuit 105 for starting the emission section 107 (each of the emission sections 107 of the laser light source 200) will be described later.

The switching element 106 performs a switching operation (namely, turn-ON and turn-OFF) based on the output of the inverter 113 into which the video signal Vo is inputted. This switching operation supplies and intercepts the driving current Id to the emission section 107. The video signal Vo inputted into the inverter 113 is a video signal of the principal scanning line corresponding to the emission section 107.

The light control circuit 120 has a photo-diode 108 that detects the light amount of the laser beam emitted by the emission section 107 and outputs a signal that presents the detected light amount. The signal outputted from the photo-diode 108 is amplified by the amplifier 109, and then, is inputted into the error amplifier 111. Reference voltage 110 corresponding to a target light amount is inputted into the error amplifier 111. The error amplifier 111 compares the signal (light amount) that is inputted from the photo-diode 108 via the amplifier 109 with the reference voltage 110 (target light amount), and outputs a differential signal S6 that presents the difference.

The differential signal S6 outputted from the error amplifier 111 is inputted into the sample hold circuit (S/H) 112 and the computing unit 117. The sample hold circuit 112 samples and holds the differential signal S6 outputted from the error amplifier 111 based on the sample hold signal S3 from the controller 210. The differential signal S6 held by the sample hold circuit 112 is inputted into the error amplifier 104 as the target current signal S4.

When an APC (Automatic Power Control) is active, the controller 210 outputs the sample hold signal S3 to control the driving current Id so that the light amount of the laser beam emitted from the emission section 107 agrees with the target light amount (the reference voltage 110). Then, when the light amount of the laser beam emitted from the emission section 107 agrees with the target light amount, the driving current Id at that time is determined as the target current, and is held by the sample hold circuit 112.

When an image is formed, the controller 210 outputs the sample hold signal S3 to the sample hold circuit 112. Then, the target current (the driving current Id at the time of the light amount of the laser beam emitted from the emission section 107 agrees with the target light amount) that is obtained by the APC and is held by the sample hold circuit 112 is outputted to the error amplifier 104 as the target current signal S4.

The amplifier 114 amplifies a signal that presents terminal voltage of the emission section 107 detected by a voltage detector provided in an anode side of the emission section 107, and performs impedance conversion. It should be noted that the terminal voltage of the emission section 107 is voltage applied between the anode and cathode of the emission section 107. Then, the output of the amplifier 114 is inputted into the error amplifier 116 as a detection result of the terminal voltage of the emission section 107. Reference voltage 115 corresponding to the target voltage set in the voltage source 101 is inputted into the error amplifier 116. The error amplifier 116 compares the output of the amplifier 114 with the reference voltage 115, and outputs the differential signal S7 that presents the difference.

The computing unit 117 controls the voltage V1 that the voltage source 101 outputs. Specifically, the computing unit 117 detects the driving current Id currently supplied to the emission section 107 and the terminal voltage of the emission section 107 based on the differential signal S6 from the error amplifier 111 and the differential signal S7 from the error amplifier 116. Then, the computing unit 117 calculates the temperature (an internal temperature or its ambient temperature) of the emission section 107 based on the driving current Id and the terminal voltage with reference to the characteristic data (for example, the characteristic data shown in FIG. 4) that is stored beforehand in a memory 121.

A graph in FIG. 4 shows an I-L-V characteristic that shows a relationship among the terminal voltage corresponding to the driving current Id for the emission section 107, the light amount, and the temperature (an internal temperature or its ambient temperature) of the emission section 107. This example associates the terminal voltage and the light amount corresponding to the driving current Id of the emission section 107 with the temperatures of 283 degrees Fahrenheit, 303 degrees Fahrenheit, and 323 degrees Fahrenheit. FIG. 4 shows that the terminal voltage of the emission section 107 and the optical output (the light amount) vary with the change of the temperature of the emission section 107 even if the emission section 107 is driven by the same driving current Id.

The temperature of the emission section 107 is calculated in high accuracy, and the calculated temperature of the emission section 107 is extremely close to the actual internal temperature or the actual ambient temperature of the emission section 107. Then, the computing unit 117 calculates target voltage VA for obtaining a target light amount by the driving current Id in the calculated temperature of the emission section 107. The target voltage VA is voltage that generates current overshot to the target current. This calculated target voltage VA is set to the voltage source 101 by the voltage setting signal S5. The voltage source 101 outputs the voltage V1 that agrees with the target voltage VA.

Thus, since the temperature of the emission section 107 is obtained based on the driving current Id and the terminal voltage of the emission section 107, it is not necessary to equip with an external temperature sensor that detects the temperature of the emission section 107. As a result, the variation of the rise time of the emission section 107 due to the temperature change of the emission section 107 can be corrected so as to be reduced with a simple configuration.

Figure 5:
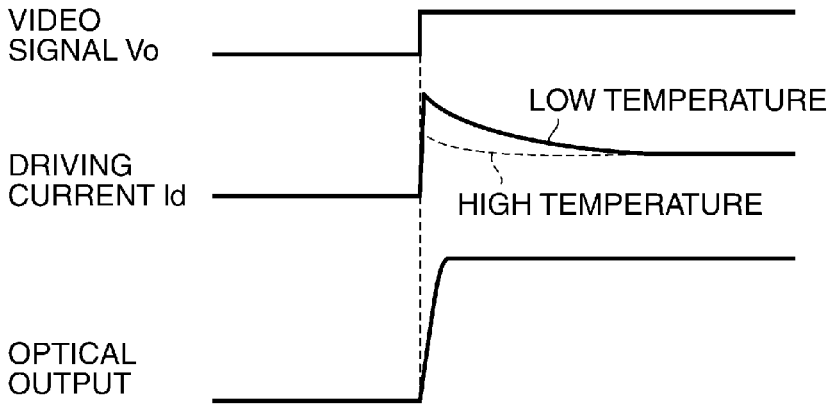
FIG. 5 is a graph showing rising waveforms of a video signal, driving current, and optical output of the emission section, when driving the emission section by the drive circuit in FIG. 3.

Next, features of the emission section 107 (vertical cavity surface emitting semiconductor laser) will be described with reference to FIG. 5. FIG. 5 is a graph showing rising waveforms of the video signal Vo, the driving current Id, and optical output of the emission section 107, when driving the emission section 107 by the drive circuit in FIG. 3.

The emission section 107 is required to raise the optical output to the target light amount immediately in response to the video signal Vo. However, the emission section 107 has the characteristic that the rise time from the rising timings of the video signal Vo to rising timings (timing to which optical output reaches the target light amount) is long under the conventional constant current control. Then, the rise time varies with the light amount of the emission section 107, temperature (the internal temperature or its ambient temperature of the emission section 107), etc.

Therefore, in this embodiment, as shown in FIG. 5, the voltage V1 (in agreement with the target voltage VA) that generates the current overshot to the target current is set to the voltage source 101, and the voltage source 101 outputs the voltage V1 to the current control circuit 103. When making the emission section 107 turn on, the current control circuit 103 supplies the driving current Id (the current overshot to the target current) generated according to the voltage V1 to the emission section 107. Then, the current control circuit 103 converges the driving current Id overshot to the target current to the target current (the target current signal S4) by the time constant (the response control signal S8) determined by the time constant circuit 105.

Accordingly, the emission section 107 rises so that the optical output reaches the target light amount immediately. That is, the driving current is corrected so that the rise time of the emission section 107 becomes short.

Specifically, in the above-mentioned drive circuit, when the video signal Vo on an L (Low) level is inputted into the inverter 113, the inverter 113 outputs the signal on an H (High) level. With the signal on the H level from this inverter 113, the switching element 106 turns OFF.

The voltage source 101 outputs the voltage V1 set by the voltage setting signal S5. Since the switching element 106 is in the OFF state at the time, the current detecting circuit 102 does not detect current. Accordingly, the response control signal S8 outputted from the error amplifier 104 becomes the signal that makes the current control circuit 103 output the maximum current (the current overshot to the target current) corresponding to the voltage V1 of the voltage source 101 as the driving current Id.

Next, when the video signal Vo on the H level is inputted into the inverter 113, the signal on the L level is outputted from the inverter 113, and the switching element 106 turns ON. Accordingly, the current control circuit 103 supplies the maximum current (the current overshot to the target current) corresponding to the voltage V1 outputted from the voltage source 101 as the driving current Id to the emission section 107. The current detecting circuit 102 detects the current supplied to the emission section 107 from the voltage source 101 via the switching element 106, and outputs the current detecting signal S9 that presents the current. The current that is detected by the current detecting circuit 102 is the current overshot to the target current, and the discharge of the capacitor of the time constant circuit 105 applies negative feedback from the output to the input of the error amplifier 104 via the time constant circuit 105. Then, the difference (the value presented by the response control signal S8 that is outputted from the error amplifier 104) between the current detected by the current detecting circuit 102 and the target current becomes small gradually while elapsing the time that is defined by the time constant determined by the time constant circuit 105. Therefore, the current control circuit 103 converges the driving current Id overshot to the target current to the target current based on the response control signal S8 with the time constant.

Such an operation applies the driving current Id overshot to the target current to the emission section 107, and raises the emission section 107 so that the optical output reaches the target light amount immediately. After that, the driving current Id overshot to the target current is controlled to converge to the target current by the above-mentioned time constant.

The voltage set to the voltage source 101 by the voltage setting signal S5, i.e., the voltage V1 outputted by the voltage source 101, is calculated based on the terminal voltage (the temperature of the emission section 107) of the emission section 107. Then, the current control circuit 103 can control the maximum current (the current overshot to the target current) that is supplied to the emission section 107 by the voltage setting signal S5 at the time of the rising of the emission section 107. Therefore, the optical output of the stable waveform can be obtained in short rise time at the time of the rising the emission section 107 without being influenced by the temperature (the internal temperature or its ambient temperature) of the emission section 107.

Here, a case where the temperature of the emission section 107 or its ambient temperature is first temperature (low temperature) and a case where the temperature is second temperature (high temperature) higher than the first temperature are assumed.

In the case of the first temperature, the voltage V1 that is outputted by the voltage source 101 according to the voltage setting signal S5 is enlarged as compared with the case of the second temperature. Accordingly, the maximum current that the current control circuit 103 supplies in the case of the first temperature becomes larger than that in the case of the second temperature. That is, as shown in FIG. 5, the higher voltage V1 is set in the lower temperature so that the rising waveform of the driving current Id in the low temperature becomes higher (the overshoot to the target current becomes larger) than that in the high temperature.

On the other hand, the voltage V1 that is set to the voltage source 101 according to the voltage setting signal S5 in the second temperature is reduced as compared with that in the first temperature. That is, as shown in FIG. 5, the lower voltage V1 is set in the higher temperature so that the rising waveform of the driving current Id in the high temperature becomes lower (the overshoot to the target current becomes smaller) than that in the low temperature.

When the emission section 107 repeats turn-ON and turn-OFF, the temperature of the emission section 107 or its ambient temperature varies. In connection with this, the rise time of the emission section 107 varies under the constant current control. Therefore, this embodiment changes the voltage V1 set to the voltage source 101 according to the voltage setting signal S5 in order to reduce the variation of the rise time of the emission section 107 due to the change of the ambient temperature of the emission section 107. Accordingly, the rise time of the optical output in the high temperature agrees with the rise time in the low temperature. This can eliminate the variation of the rise time due to the temperature change, and can prevent deterioration of image quality.

Figure 6:
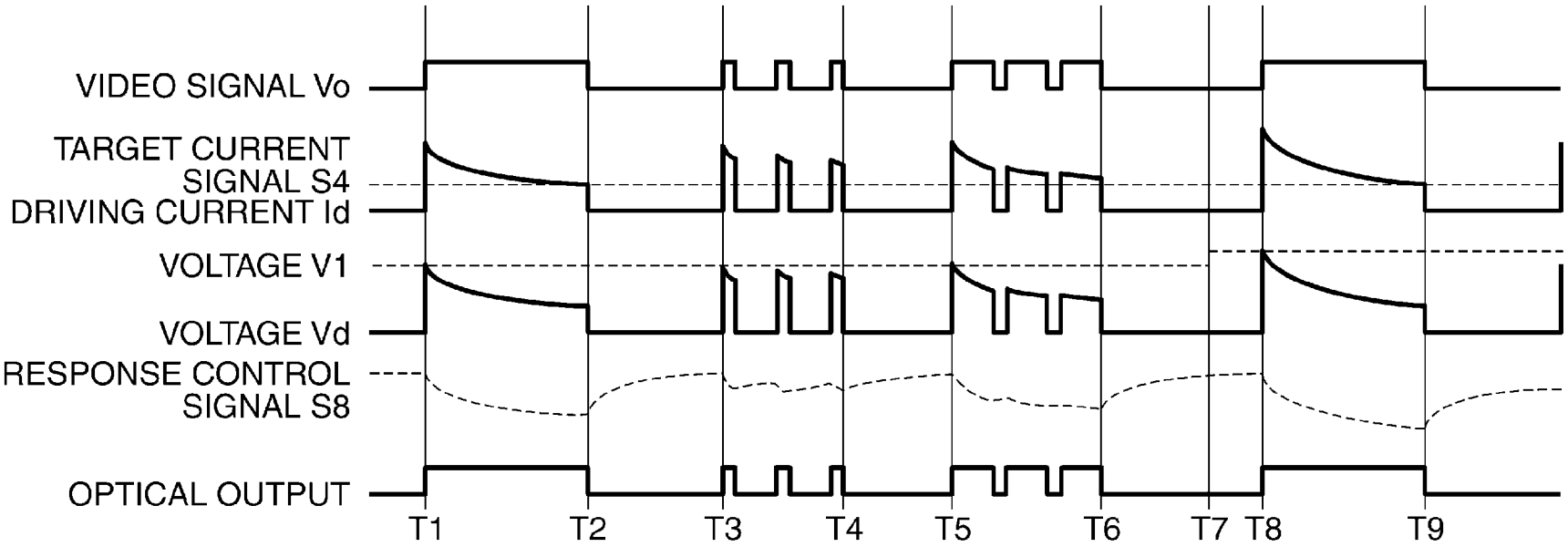
FIG. 6 is a graph showing waveforms of a video signal, driving current, a target current signal, output voltage of a voltage source, applied voltage to the emission section, a response control signal, and the optical output, when the voltage source in the drive circuit in FIG. 3 changes output voltage.
Figure 7:
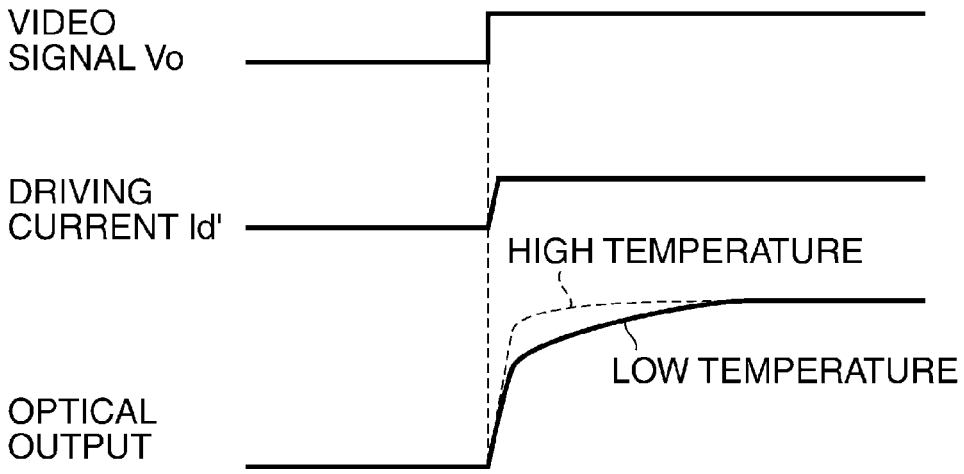
FIG.7 PRIOR ART
FIG. 7 is a graph showing rising waveforms of a video signal, driving current, and optical output of an emission section, when driving the emission section by the conventional constant current control.

A case where the voltage V1 outputted from the voltage source 101 varies will be described with reference to FIG. 6. FIG. 6 is a graph showing waveforms of the video signal Vo, the driving current Id, the target current signal S4, the output voltage V1 of the voltage source 101, the applied voltage Vd to the emission section 107, the response control signal S8, and the optical output, when the voltage source 101 changes the output voltage V1.

As shown in FIG. 6, in an initial state in which the switching element 106 is in the OFF state, the driving current Id does not flow into the emission section 107, and the current detecting circuit 102 has not detected current. At this time, the voltage source 101 is outputting the voltage V1 that is set according to the voltage setting signal S5, and the current control circuit 103 is in the operating state to supply the maximum current according to the response control signal S8 from the error amplifier 104.

When the video signal Vo on the H level is inputted into the inverter 113 at the timing T1, the inverter 113 outputs the signal on the L level and the switching element 106 turns ON. Then, the current control circuit 103 supplies the maximum current (the current overshot to the target current) corresponding to the voltage V1 outputted from the voltage source 101 as the driving current Id to the emission section 107. The current (the current detecting signal S9) that is detected by the current detecting circuit 102 becomes larger than the target current (the target current signal S4).

The error amplifier 104 outputs the response control signal S8 that presents the difference between the current corresponding to the current detecting signal S9 and the target current corresponding to the target current signal S4. The difference that is presented by the response control signal S8 is the time that is defined by the time constant determined by the time constant circuit 105, and varies so as to decrease gradually. The current control circuit 103 converges the driving current Id to the target current according to the response control signal S8 from the error amplifier 104 during the time that is defined by the time constant determined by the time constant circuit 105. At the same time, the applied voltage Vd to the emission section 107 falls gradually from the voltage V1.

When the video signal V0 is set to the L level at the timing T2, the switching element 106 turns OFF. Accordingly, the current that is detected by the current detecting circuit 102 becomes smaller than the target current (the target current signal S4). Therefore, the difference that is presented by the response control signal S8 of the error amplifier 104 increases gradually, and the current control circuit 103 increases the driving current Id.

When the video signal Vo of which duty is lower than the video signal Vo in a period between the timings T1 and T2 is inputted into the inverter 113 in a period between the timings T3 and T4, the switching element 106 turns ON and turns OFF based on the video signal Vo concerned. During the period between the timings T2 and T3, the time constant circuit 105 (capacitor) is fully saturated, and the voltage source 101 outputs the voltage V1 at the timing T3.

When the switching element 106 turns ON, the difference that is presented by the response control signal S8 decreases gradually. On the other hand, when the switching element 106 turns OFF, the difference that is presented by the response control signal S8 increases gradually. Thus, the difference that is presented by the response control signal S8 repeats increase and decrease in response to turn-ON and turn-OFF of the switching element 106.

The temperature of the emission section 107 varies so as to repeat a rise and a drop in response to lighting-up and lights-out of the emission section 107. This fluctuates the rise time of the emission section 107.

However, since the lighting-up time of the emission section 107 is shorter than the lights-out, the temperature of the emission section 107 varies slightly, and the fluctuation of the rise time of the emission section 107 is small. Therefore, it is unnecessary to change the voltage V1 set to the voltage source 101 according to the voltage setting signal S5, and so, the voltage V1 set according to the voltage setting signal S5 is held as is.

When the video signal VO varies to the L level at the timing T2, the switching element 106 turns OFF. Accordingly, the current control circuit 103 becomes to the operating state that increases the driving current Id according to the response control signal S8 from the error amplifier 104.

When the video signal Vo with high duty is inputted in a period between the timings T5 and T6, the switching element 106 turns ON and turns OFF based on the video signal Vo concerned. During the period between the timings T4 and T5, the time constant circuit 105 is fully saturated, and the voltage source 101 outputs the voltage V1 at the timing T5.

Since the lighting-up time of the emission section 107 is longer than the lights-out in the period between the timings T5 and T6, the difference that is presented by the response control signal S8 decreases gradually by repeating slight increase and decrease according to turn-ON and turn-OFF of the switching element 106. Accordingly, the waveform of the rising of the driving current Id becomes lower than the waveform of the next rising, which cannot shorten the rise time of the emission section 107. The temperature of the emission section 107 or its ambient temperature rises, and the rise time of the emission section 107 varies to be shortened.

Therefore, since the rise time of the emission section 107 in the high temperature is short even if the waveform of the rising of the driving current Id becomes low, a rise time is substantially corrected so as to shorten. That is, the output waveform of the emission section 107 can be stabilized with a short rise time without changing the voltage V1 set to the voltage source 101 according to the voltage setting signal S5.

Suppose that the rise time of the emission section 107 became long at the timing T7 due to the fall of the temperature of the emission section 107 or its ambient temperature. In this case, the voltage V1 set to the voltage source 101 increases, and the voltage setting signal S5 for setting this increased voltage V1 is outputted to the voltage source 101. Accordingly, the voltage source 101 outputs the larger voltage V1 than the voltage V1 before the timing T7.

When the video signal Vo of H level is inputted in the period between the timings T8 and T9, the current control circuit 103 supplies the driving current Id to the emission section 107. The waveform of the rising of this driving current Id becomes higher than the waveform of the rising of the driving current Id at the timing T1. Accordingly, the rise time of the emission section 107 that became large due to the fall of the ambient temperature of the emission section 107 is shortened, and an optical output that reaches the target light amount immediately can be obtained at the time of the rising of the emission section 107.

When changing the voltage V1 set to the voltage source 101, the voltage for generating the current overshot to the target current is calculated based on the current terminal voltage of the emission section 107 (the temperature of the emission section 107 or its ambient temperature) and the optical output, as mentioned above. Then, the above-mentioned calculated voltage is set to the voltage source 101 in place of the currently set voltage V1.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-009698, filed on Jan. 20, 2011, which is hereby incorporated by reference herein in its entirety.

What is claimed is:

1. An image forming apparatus comprising:

a laser light source configured to emit a laser beam according to a driving signal to expose a photosensitive member;

a voltage detection unit configured to detect terminal voltage of the laser light source;

a driving current supplying unit configured to supply a driving current to the laser light source;

a current detection unit configured to detect a driving current value of the driving current supplied to the laser light source; and a control unit configured to specify an emission characteristic representing a correspondence relationship between the driving current value detected by the current detection unit and an amount of the laser beam emitted from the laser light source due to supply of the driving current, based on a correspondence relationship between the driving current value detected by the current detection unit and the terminal voltage detected by the voltage detection unit, and to control the driving current supplying unit based on the specified emission characteristic such that a current value exhibited at the start of the driving current being supplied is current overshot above a target current value and then the driving current being converged to the target current value with a predetermined time constant from the overshot current value is supplied to the laser light source.

2. The image forming apparatus according to claim 1, further comprising a storage unit configured to store characteristic data that associates the correspondence relationship between the driving current value and the terminal voltage with respect to a plurality of temperatures, and characteristic data that associates the correspondence relationship between the driving current value and the amount of the laser beam with respect to a plurality of temperatures, wherein the control unit calculates the temperature of the laser light source based on the correspondence relationship between the driving current value and the terminal voltage, and controls the driving current supplying unit based on the calculated temperature.

3. The image forming apparatus according to claim 1, wherein the driving current supplying unit has a time constant of an operation in response to the driving signal, and wherein the driving current supplying unit supplies the current that converges to the target current with the time constant after overshooting to the target current to the laser light source.

4. The image forming apparatus according to claim 3, wherein the driving current supplying unit has a time constant circuit including a capacitor to determine the time constant.

5. The image forming apparatus according to claim 1, wherein the voltage detection unit comprises an amplifier having a first terminal connected to the driving current supplying unit and a second terminal connected to a reference electric source, and detects the terminal voltage of the laser light source by comparing a voltage of the first terminal and a voltage of the second terminal.

* * * * *